United States Patent [19]

Queen

[11] Patent Number: 4,523,341

[45] Date of Patent: Jun. 18, 1985

[54] BATHING CABINET WITH TRANSPORTER CART

[76] Inventor: Carl J. Queen, 8408 Kelso Dr., Lake Park, Fla. 33410

[21] Appl. No.: 560,381

[22] Filed: Dec. 12, 1983

[51] Int. Cl.[3] ..... A47K 3/022

[52] U.S. Cl. ..... 4/555; 4/560; 4/584; 4/569

[58] Field of Search ..... 4/540, 546, 548, 553, 4/555–566, 569, 571, 573, 584, 604, 607, 610, 611, 621

[56] References Cited

U.S. PATENT DOCUMENTS

| | | | |
|---|---|---|---|
| 3,169,253 | 2/1965 | Segar | 4/611 |
| 3,662,409 | 5/1972 | Johannson | 4/560 |
| 3,703,733 | 11/1972 | McLoughlin | 4/560 |
| 3,832,740 | 9/1974 | McClarrin | 4/611 |
| 4,112,524 | 9/1978 | Johansson | 4/560 X |

*Primary Examiner*—Charles E. Phillips
*Attorney, Agent, or Firm*—Barry L. Haley

[57] ABSTRACT

A bathing system for ambulatory or non-ambulatory patients that includes a bathing cabinet with associated showering plumbing and a patient transporter cart that is moveable into and out of the cabinet, eliminating bodily transfer of the patient into and out of the bath from a wheelchair. The bathing cabinet has water shielded channels that receive and protect the wheels and casters of the transporter cart from becoming wet during the bathing operation when the cart is locked inside the bathing cabinet. The transporter cart includes a perianal spray that has a pipe coupling element that connects automatically during insertion of the cart to a pipe fitting disposed in the cabinet. The bathing cabinet includes a foot bathing receptacle that can be emptied with a mechanical flipper valve.

The arm and foot rests of the transporter cart are removeable and can be stored on the outside of the cabinet during the bathing operation so that they do not get wet.

5 Claims, 10 Drawing Figures

BATHING CABINET WITH TRANSPORTER CART

BACKGROUND OF THE INVENTION

This invention relates to therapeutic and bathing systems, especially suited for non-ambulatory, immobile patients found in canvalescent homes, nursing homes or hospitals. The bathing system greatly reduces patient handling and transfer, saving time and more importantly increasing safety for the patient.

Statistically many accidents involving non-ambulatory (and ambulatory) patients in institutional care centers occur during the transfer of the patient from a wheelchair to or from the bath. The bathing environment is especially hazardous because the patient is wet and more difficult to hold firmly during transfer and removal from the bathing device.

Conventionally, the patient is placed into a wheelchair from a bed, wheeled to a bathing device, transferred into and out of a bath and wheeled back to the bed. This requires four separate transfers, at least one while the patient is wet.

Elaborate patient transfer systems, some including hoists, powered lifts and the like, are shown in the prior art as attempts to make patient transfer into and out of the bathing cabinet more safe. Examples are shown in U.S. Pat. No. 3,703,733 and U.S. Pat. No. 3,169,253. Johansson in U.S. Pat. No. 3,662,409 shows a transfer cart wherein the chair of the wheelchair is separable from the frame and wheels and is hydraulically assisted to transfer the patient into the cabinet on rails. This requires additional wheels, rails a hydraulic boost system, and safety locks to prevent chair separation and the additional hazard to the patient that the transfer mechanism will not function properly.

Another approach to the problem is to provide a portable bathing cabinet that is brought to the patient's bedside, such as shown in U.S. Pat. No. 3,616,467 and U.S. Pat. No. 3,832,740.

Segar in U.S. Pat. No. 3,169,253 shows a mobile chair for shower facilities that has grooved wheels that engage rails in a shower area. Because the wheels are exposed to the shower spray, the wheels and frame when wet will create wet and slippery floors beyond the shower area, creating additional hazards.

The present invention overcomes the problems discussed above by providing a practical, safe, and relatively inexpensive bathing system that does not require hydraulically assisted components, eliminates body transfer of the patient between the wheelchair and the bathing cabinet, while leaving the floor area surrounding the bathing cabinet free from water or soapy liquids. The patient can also have a foot bath and perianal spray using the present invention.

SUMMARY OF THE INVENTION

A system for bathing a non-ambulatory (or ambulatory) patient that eliminates transfers (to and from) of the patient between the wheelchair and the bathtub or bath housing. The system utilizes a bathing enclosure that may be permanently installed at a desired location and a wheeled patient transfer cart that is received within the bathing enclosure throughout the bathing procedure.

The bathing enclosure includes a water-tight housing having a hinged door at the front which opens to permit introduction and removal of the transfer cart, an interior pipe network to provide a water, soap and medicant spray, hand-held shampoo spray, foot bath, hot and cold water controls and a soap injector system, all controlled from a strategically located panel readily accessible by the attendant.

The bathing enclosure housing includes a floor or bottom that is shaped to provide a foot bath receptacle and a collecting area with a drain. The side walls of the bottom are separated from the exterior side walls of the housing sufficiently spaced apart on each side to form two channels traversing from front to rear that receive the transfer cart wheels and certain cart frame members. The floor side walls, in conjunction with additional panels mounted above and overlapping the bottom side walls, shield the transfer cart wheels, casters, and cart frame members connected to the wheels from the bathing water and other liquids dispensed during the patient bathing, while the cart is inside the enclosure.

The patient transfer cart includes a seating surface, a backrest, and removeable arm and foot rests coupled to a supporting frame, casters, and four wheels.

Each wheel and caster is connected to the frame by a horizontally extending support member and a vertical support member. The frame members may be rigid metal tubes. The vertical and horizontal members are sized and connected to each other to provide sufficient clearance between the wheels and frame members of the cart and the housing channels that receive the wheels.

The cart also has a horizontal surface (mounted under the seat) with a large aperture that receives a bucket that collects waste materials passing through a hole in the seat for incontinent patients. The bucket is removed whenever the cart is inside the housing.

The cart seat includes a spray nozzle and piping to provide a perianal spray, and a pipe coupling that connects into a pre-aligned fluid fitting mounted on the back interior wall of the bathing enclosure. As the cart is moved backwards into the proper location within the bathing enclosure, the pipe coupling on the cart engages the housing fitting automatically without attendant intervention.

The lower exterior walls of the housing on each side have openings that permit the attendant to lock one or more wheels of the cart once the cart is properly located inside the housing.

The cart arm rests and foot rests may be removed just prior to placing the cart (with the patient) inside the bathing enclosure and hung on a rack located on an exterior wall of the housing. This prevents the arm and foot rests from becoming wet while the patient is being bathed.

In operation, the patient is transfered from a bed onto the transfer cart. The cart and patient are then moved into proximity with the bathing enclosure. The foot rests ( and arm rests if desired) are removed and placed on the exterior rack. The front door of the enclosure is opened, and the cart is moved, with the patient on board, backwards into the enclosure. Once the seat pipe coupling is engaged with the housing fitting, the attendant locks a wheel on the cart and closes the door.

The patient can now receive a bath, a shampoo, a foot bath and a perianal wash through manipulation of the controls by the attendant.

The cart wheels, casters, frame support members, arm rests and foot rests remain dry during the bathing operation. Once the bathing operation is completed, the cart, with the patient thereon, is removed from the bathing enclosure, the arm and foot rests reattached and the patient transported within proximity of his or her bed and transferred from the cart to the bed.

It is an object of this invention to provide a bathing system for a patient that eliminates physical transfer of a patient between a wheelchair and a bathing cabinet.

It is another object of this invention to provide a bathing system that includes bathing spray, shampoo spray, perianal spray and foot bath, the system eliminating patient transfer between a wheelchair and the bathing enclosure.

And yet another object of the invention is to provide a bathing system that permits a patient to be mounted and wheeled into and out of the bathing enclosure without permitting the wheels and wheel support frame members from becoming wet during the bathing operation with the cart inside the bathing enclosure.

BEST MODE FOR CARRYING OUT THE INVENTION

Figure 1:
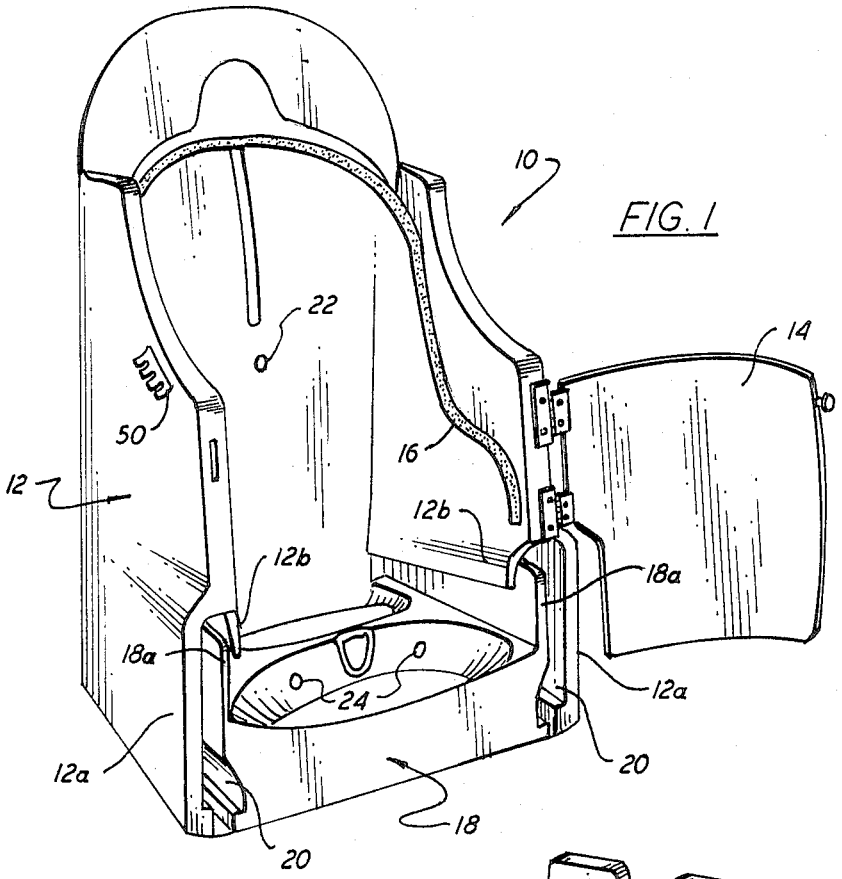
FIG. 1 shows a front perspective view of the bathing cabinet (with the front door open) as employed in the present invention.

The bathing cabinet 10 is shown in FIG. 1 with the door 14 open. The cabinet 10 has two separate and distinguishable sections, namely housing 12 and floor basin 18 integrally joined along the rear inside wall to form the bathing enclosure. Vertical side walls 18*a* of the floor basin 18 are separated from exterior housing walls 12*a* by channels 20 to permit the wheels and frame members of a transporter cart (not shown in FIG. 1) to be received into the cabinet 10 while protected from water or liquids by panels 12*b*.

The cabinet housing 12 has three major vertical double walls molded in panels, joined together as inner and outer walls, the inner wall acting a three sided water barrier. Thus, the cabinet 12 includes a three-sided, double walled housing 12*a* constructed of a molded polyester resin reinforced with fibreglass. The door 14 (mounted by hinges) encloses the cabinet when the door is closed. The floor basin 18 of the cabinet 12 and basin side walls 18*a* are separate from the housing side walls 12*a*. The floor basin 18 includes a foot bath chamber 18*b* and a rear chamber 18*c* with a drain for the cabinet (not visible in FIG. 1).

A spray tube 16 mounted inside the cabinet provides the water, soap or medicant spray for bathing the patient while seated inside on the transporter cart. Additional plumbing is connected to the foot bath openings 24 that fill the foot bath chamber 18*b*.

Figure 2:
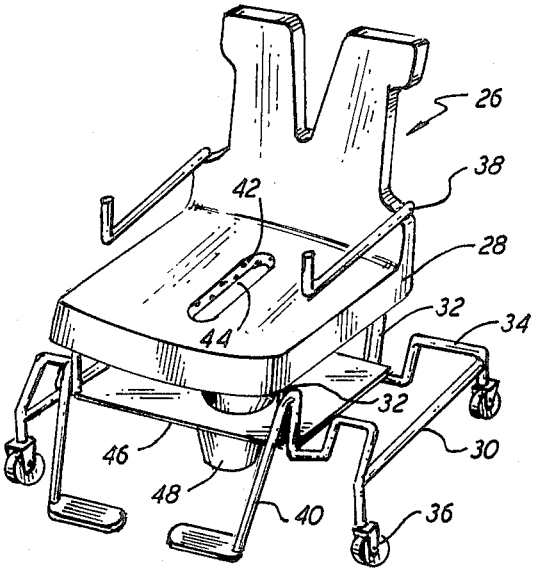
FIG. 2 is a front perspective view of the patient transporter cart employed in the present invention.

The transporter cart 26 (FIG. 2) can be wheeled (backwards) into the bathing cabinet 12. The transporter cart 26 is comprised of a seat 28 mounted on vertical frame members 32 rigidly attached to wheels 36 by uniquely configured frame members 34. Additional support is achieved with horizontal frame members 30. The frame configuration permits the wheels to be received into channels 20 formed between the cabinet exterior housing walls 12*a* and the floor basin walls 18*a*. The wheels 36 and frame members 34 are shielded from any liquids sprayed inside the cabinet by the panels 12*b* that overlap the opening above the floor basin walls 18*a*. Thus the wheels 36 can not ever become wet throughout the bathing operation.

The cart 26 includes a lower horizontal platform 46 having a bucket 48 that can be used for incontinent patients. The bucket 48 is removed by the attendant before the cart 26 is moved into the bathing cabinet to permit clearance of the lower frame of the cart over the raised bottom front wall 18 of the cabinet.

The perianal spray 44 and recessed portion 42 is described in greater detail below. The arm rests 38 and foot rests 40 are removeable prior to placing the cart 26 into the bathing cabinet and placed on side rack 50 where they remain dry during patient bathing.

Figure 4:
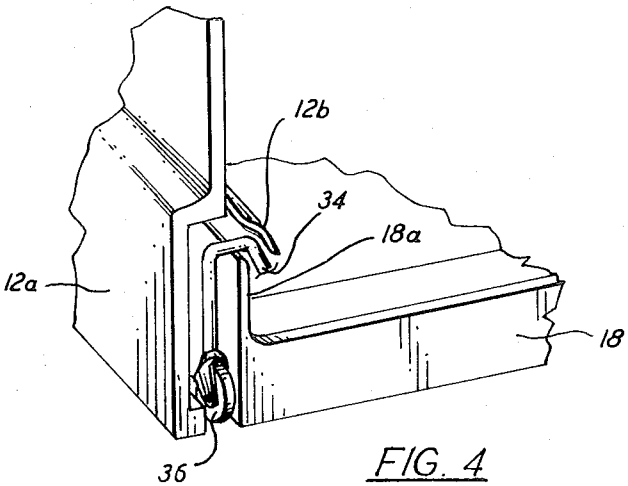
FIG. 4 is a partially cut-away view of the lower portion of the bathing cabinet wheel receiving channel with a wheel and frame of the transporter cart disposed therein.
Figure 3:
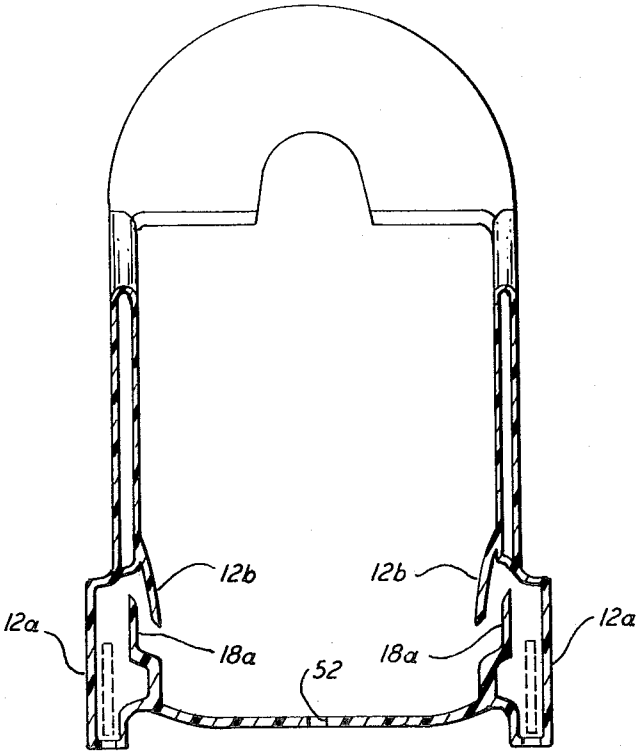
FIG. 3 is a front elevational view in cross section of the bathing cabinet.

FIG. 3 shows the channel 20 formed between the cabinet housing wall 12*a* and basin walls 18*a* which permits the cart 26 to be moved into and out of the bathing cabinet and the panel 12*b* extending from the upper inside cabinet wall overlapping the opening to prevent liquid from entering channel 20. FIG. 4 shows the cart frame configuration of one cart wheel as it enters channel 20.

Figure 5A:
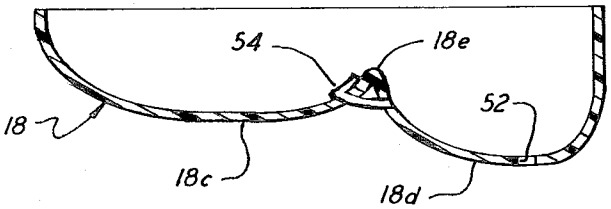
FIG. 5A is a side elevational, schematic view of the bottom configuration of the bathing cabinet and drain.
Figure 5B:
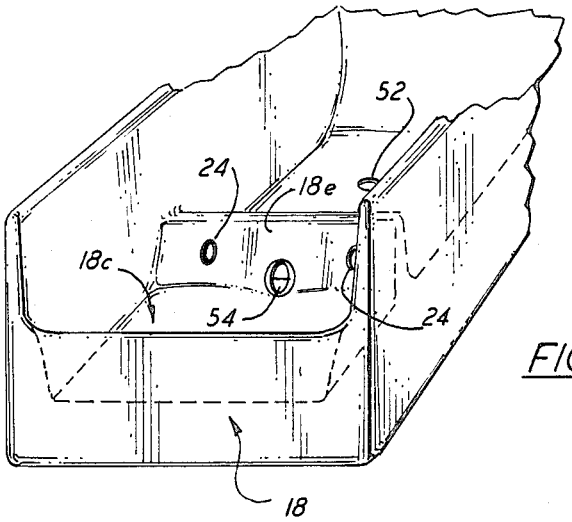
FIG. 5B is a perspective view of the bottom of the bathing cabinet showing the foot bath chamber and drain plug.

FIGS. 5A and 5B show the shape of the floor basin 18 with a foot-bath receptacle 18*c* located in the forward section of the cabinet and a rear receptacle 18*d* having the cabinet drain 52 at its lowest point. Wall section 18*e* includes a mechanically actuated flapper valve 54 operated by a mechanical linkage (not shown) that allows foot-bath receptacle 18*c* to be filled and emptied by the attendant.

Figure 6A:
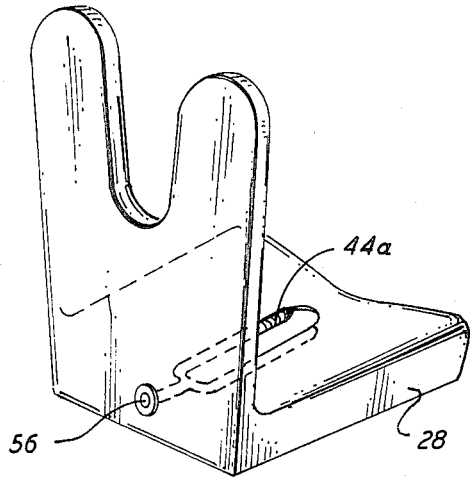
FIG. 6A shows the transporter cart seat in phantom with the tubing and spray used for the perianal bath with the pipe coupling member.
Figure 6B:
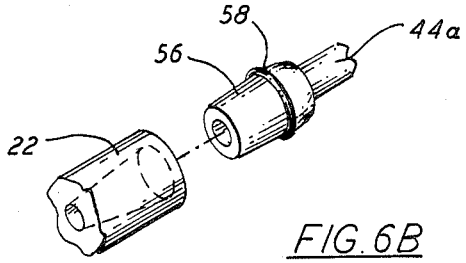
FIG. 6B shows the pipe coupling member of the cart with the female fitting used on the bathing housing.

FIG. 6A shows the cart seat 28 in phantom and the internal plumbing to provide a perianal spray for the seated patient. A spray tube 44*a* is mounted inside seat 28 to allow spray through seat apertures 44 disposed in recessed opening 42. The tube 44*a* is connected to a coupling 56 having a "O" ring 58 that is received into a fitting 22 in the back inside wall of the cabinet housing. A tube internally mounted in the cabinet housing supplies water to tube 44*a* whenever the cart is positioned inside the cabinet. The coupling 56 is aligned and protrudes from the seat back such that it will engage the pipe fitting 22 when the cart is pushed back into the cabinet in the proper position. No additional operator action is required other than turning the water supply valve for the perianal spray on or off.

Figure 7:
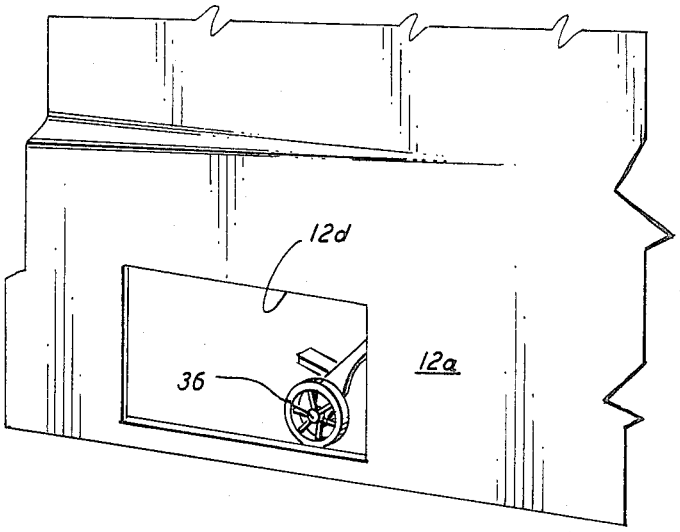
FIG. 7 shows a cut-away perspective view of one side of the bathing housing that has an opening to allow the attendant to lock one wheel on the transporter cart when it is positioned inside the bathing cabinet.

FIG. 7 shows an opening 12*d* in wall 12*a* of the cabinet housing that permits attendant access to the cart wheels 36 when the cart is inside the housing so that in the bathing position, the wheels can be locked by the attendant so that the cart will not move inside the cabinet.

Figure 8:
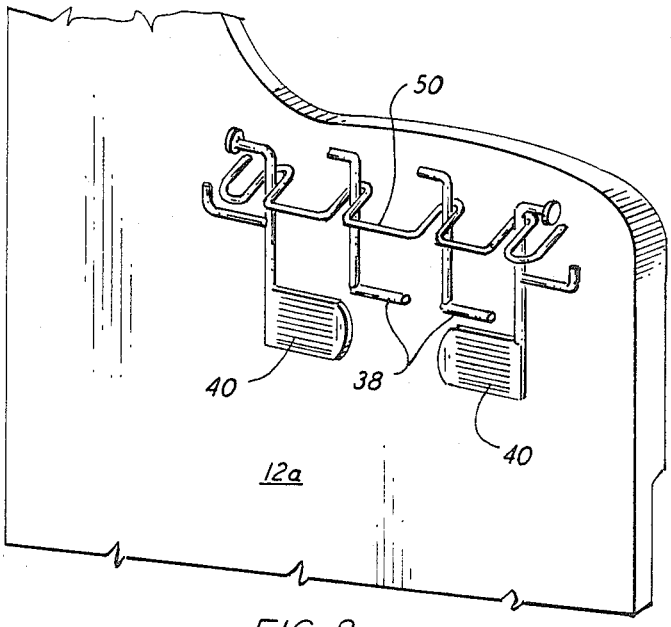
FIG. 8 shows a perspective view of the rack mounted on the side of the bathing cabinet for holding the arm and foot rests of the transporter cart.

FIG. 8 shows the rack 50 that is used to hold the arm rests 38 and foot rests 40 outside the cabinet during the bathing operation.

As described above the bathing system comprising the present invention can provide a seated patient with a bathing spray, a shampoo spray, a perianal spray, and a foot bath, the control valves of which are located at a convenient position on the housing that is accessible by the attendant. The patient need not be transferred from a wheelchair into and out of the bathing enclosure. The patient cart frame and wheels remain dry throughout the bathing operation leaving the surrounding floor areas dry. A patient can be quickly and safely bathed and dryed on the transporter cart.

What I claim is:

1. A bathing system comprising:

a bathing enclosure;

a patient transporter cart;

means for rolling said cart connected to said cart; said cart and means for rolling being positionable inside said enclosure;

means disposed in said bathing enclosure for providing a fluid spray inside said enclosure;

said bathing enclosure including means for shielding said cart rolling means from fluids sprayed inside said enclosure by said means for providing a fluid spray during a bathing operation with said cart and means for rolling inside said enclosure.

2. A bathing system as in claim 1, wherein:

said cart includes a patient seat, means for providing a perianal spray connected to said seat, pipe coupling means connected to said perianal spray means, and pipe fitting connected to said enclosure, said pipe coupling and said pipe fitting being aligned for engagement and engageable when said cart is positioned at a particular location within said enclosure and disengageable when said cart is removed from said enclosure.

3. A bathing system as in claim 1, including:

a forward receptacle in said enclosure for providing a foot bath for a patient disposed on said cart whenever said cart is positioned inside said enclosure.

4. A bathing system as in claim 1, wherein:

said cart includes removeable arm rests and removeable foot rests.

5. A bathing system as in claim 1, wherein:

said enclosure includes access means for allowing an attendant to engage the cart rolling means from the enclosure exterior whenever the cart is disposed inside the enclosure.

* * * * *